US006164016A

United States Patent [19]

Bue et al.

[11] Patent Number: 6,164,016

[45] Date of Patent: Dec. 26, 2000

[54] DECK CONNECTOR

[75] Inventors: Richard C. Bue, Chaska; Mark DeSimone, Hopkins, both of Minn.

[73] Assignee: Sico Incorporated, Minneapolis, Minn.

[21] Appl. No.: 08/904,696

[22] Filed: Aug. 1, 1997

[51] Int. Cl.[7] ..... E04B 5/02

[52] U.S. Cl. ..... 52/7; 52/127.8; 52/127.6; 52/483.1; 52/767; 403/53; 108/169; 108/167

[58] Field of Search ..... 52/7, 12, 127.8, 52/127.6, 483.1, 767, 482; 403/53, 54, 217; 108/169, 167, 155, 159; 248/278.1, 279.1

[56] References Cited

U.S. PATENT DOCUMENTS

| | | | |
|---|---|---|---|
| 3,627,244 | 12/1971 | Nicholas | 248/279.1 |
| 3,988,872 | 11/1976 | Adamson et al. | 52/752 |
| 4,089,522 | 5/1978 | Rock | 108/167 |
| 4,522,008 | 6/1985 | Zeigler et al. | 52/646 |
| 5,035,186 | 7/1991 | Uredat et al. | 108/159 |
| 5,317,842 | 6/1994 | Rogers et al. | 52/7 |
| 5,323,563 | 6/1994 | Rogers et al. | 52/7 |
| 5,325,640 | 7/1994 | Luedke et al. | 52/8 |
| 5,349,789 | 9/1994 | Andert et al. | 52/7 |
| 5,613,450 | 3/1997 | Wagner et al. | 108/175 |
| 5,615,451 | 4/1997 | Peterson | 52/126.1 |

FOREIGN PATENT DOCUMENTS

| | | | |
|---|---|---|---|
| 470502 | 8/1937 | United Kingdom | 248/278.1 |
| WO 93/03240 | 2/1993 | WIPO . | |

*Primary Examiner*—Carl D. Friedman
*Assistant Examiner*—Phi Dieu Tran A
*Attorney, Agent, or Firm*—Merchant & Gould P.C.

[57] ABSTRACT

A folding stage includes deck connectors that are configured for engaging a bore formed in the decks. The connectors may extend outward to support bridging decks adjacent the stage. Pin-type connectors are rotatable into a retaining position are rotatable downward below the decks. The connectors may also be turned to extend beyond the edge of the stage decks or be retracted to a position below the stage deck when not used for bridging. A deck retainer includes a retaining tab portion at one end for retaining bridging decks against the stage decks as well as the lifting surface at the other end which may engage the bottom of the decks to lift the decks so that the connectors may be turned.

8 Claims, 8 Drawing Sheets

DECK CONNECTOR

BACKGROUND

1. Field of the Invention

The present invention is directed to an apparatus for retaining decks on a folding stage and for retaining and supporting bridging decks between the stages.

2. Prior Art

Elevationally adjustable folding stages are well known in the art. Such stages can bridge additional decks between the stages to create an extended stage surface. The rectangular decks of such stages are typically removable and reversible. Some stages are retained at each corner by a retaining pin. An example of such a stage is shown in U.S. Pat. No. 5,325,640 to Luedke and assigned to Sico Incorporated, the assignee of the present invention. An example of connectors for decks is shown in U. S. patent application Ser. No. 5,701,703 to Luedke, also assigned to Sico Incorporated.

The Luedke patents show a folding stage having a pin connector which is rotated to compress downward and expand an annular center member radially outward. The annular member engages the bore of the deck and retains the deck against the frame. In addition, the Luedke patents show insertable bridging elements which support other pin connectors beyond an edge of the deck. The additional pin connectors allow for supporting bridging decks between stages on the frames. The Luedke patents also show retainers for storing bridging decks on the stage decks and retaining the decks in the folded storage position.

Although the connectors and bridging system shown in the Luedke patents provide a safe, sturdy and reliable system for retaining decks and for supporting bridging decks between stages, still further improvements are possible. The Luedke patents require removal of the bridging support and replacement with a non-bridging support when a bridging deck is not being supported. Moreover, when a bridging deck is added, the bridging support elements must be mounted to the stage prior to supporting the bridging decks. In order to perform this operation, the stage decks must be removed to access the frame for attaching and removing the bridging supports. As the decks may be relatively heavy, deck removal and replacement can be cumbersome as well as a time consuming operation. Moreover, for building an extended stage surface requiring multiple stages and bridging decks, the overall time and effort expended may be substantial.

In addition, at the comer of the stage, different connectors must be used if one or three other decks are being bridged off the stage. The Luedke patents teach a double or a quadruple bridging support element, but do not provide elements that can each be adaptable to supporting either one or three bridging decks.

It can be seen then that a new and improved folding stage and deck connector apparatus is needed. A need exists for a stage that is capable of supporting bridging decks and for having a single bridging support element at each corner that can support either one or three bridging decks. Moreover, such a system should provide for easily changing between a configuration supporting one or three bridging decks and for eliminating the need for removing the decks of each stage for such adjustments. The present invention addresses these, as well as other problems associated with folding stages and bridging deck support systems.

SUMMARY OF THE INVENTION

The present invention is directed to a deck support and, in particular, to a deck connector for a folding stage which provides for supporting bridging decks between stages.

The deck supports of the present invention include a pin-type connector element to extend into a bore in the stage decks. The pin-type connector includes a compressible annular member which is compressible axially and expands radially outward to engage the wall of the bore and retain the stage decks. In addition, the present invention provides for supporting bridging decks between the stages. The bridging connectors include pin-type connectors extending beyond the edge of the stage decks to engage and support the bridging decks. The bridging connectors are rotatably mounted at the corners and center of the stage to align connectors with the bores in adjacent supported bridging decks. The corner connector may support up to three bridging type connectors for supporting a deck diagonally, as well as off of each edge of the stage. In this manner, an extended stage surface can be formed using a fewer number of stages. The connectors are rotatably mounted on a base and may be turned upward to support or flipped downward for turning the base below the stage deck in a non-bridging configuration, or for rotating only to support one deck off of the stage.

It can be appreciated that to turn the connector base, it is necessary to either remove or lift the stage decks. The present invention also provides a bridging deck retainer which stores bridging decks on the stage decks even in the folded storage position. In addition, the retainers at the edge of the stage include an engaging surface for engaging the bottom of the stage deck and lifting it upward to disengage the stage deck from the base of the connector. This provides for freely turning of the bridging support to a desired position.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT

Figure 1:
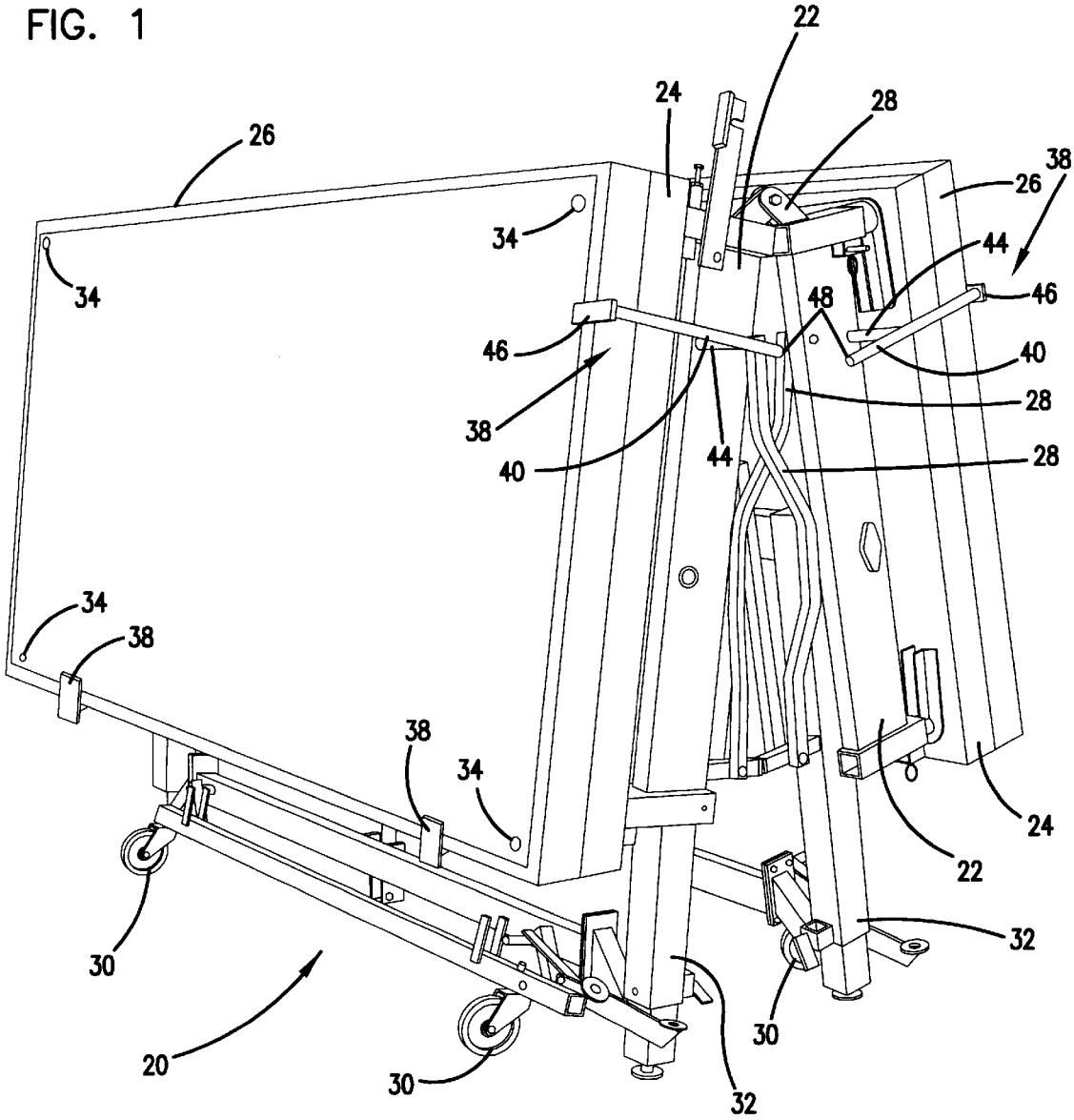
FIG. 1 shows a perspective view of an elevationally adjustable folding stage in a folded position retaining additional decks.
Figure 2:
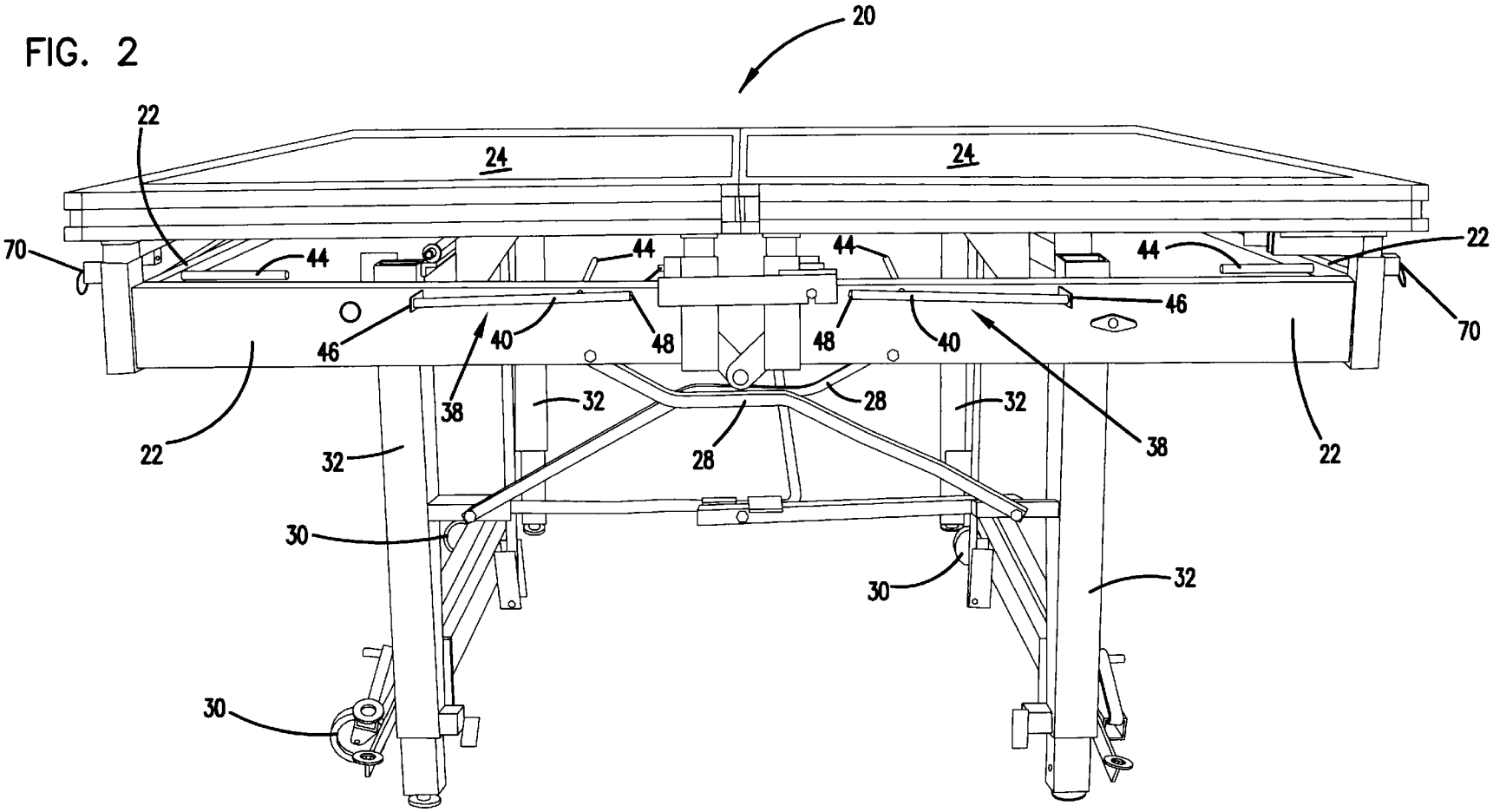
FIG. 2 shows a perspective view of the elevationally adjustable folding stage shown in FIG. 1 in an unfolded use position.

Referring now to the drawings, wherein like reference numerals and letters indicate corresponding structure throughout the several views, and in particular to FIGS. 1 and 2, there is shown an elevationally adjustable folding stage, generally designated 20. The stage 20 shown is an elevationally adjustable folding stage, however other stages that utilize bridging decks for creating an extended stage surface are also contemplated. The stage 20 supports removable and reversible decks 24 on a framework 22. The framework 22 is a folding framework which folds with a folding linkage 28. The stage 20 is supported in its folded position on casters 30 that may be engaged or disengaged in the use position. Telescoping legs 32 provide for raising and lowering the height of the stage 20 in its use position and are typically always engaged in the folded storage position. In the use position shown in FIG. 2, stages 20 may be joined to form an extended stage surface or bridging decks may be supported between stages 20 to form an extended elevated stage surface. In the folded position, as shown in FIG. 1, additional bridging decks 26 may be stored on top of the stage decks 24. Retainers 38 along the bottom and sides of the decks ensure that the bridging decks 26 are securely retained against the stage decks 24, even in the folded position where the decks 24 are not horizontal. As the decks fold to a narrower profile requiring less storage space, no additional space is required for storing the additional bridging decks 26. U.S. Pat. No. 5,325,640 to Luedke et al., shows a stage with bridging deck storage and is incorporated herein by reference.

Figure 3:
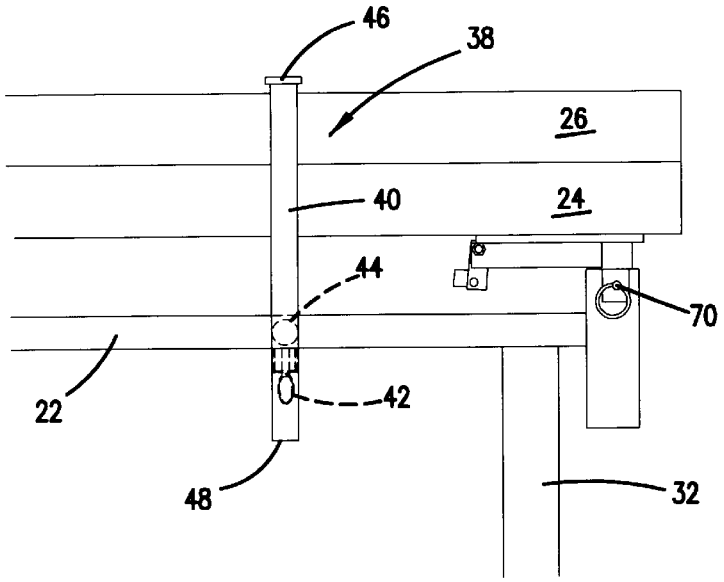
FIG. 3 shows a side elevational view of the stage shown in FIG. 1 and a deck retainer in a retaining position.
Figure 4:
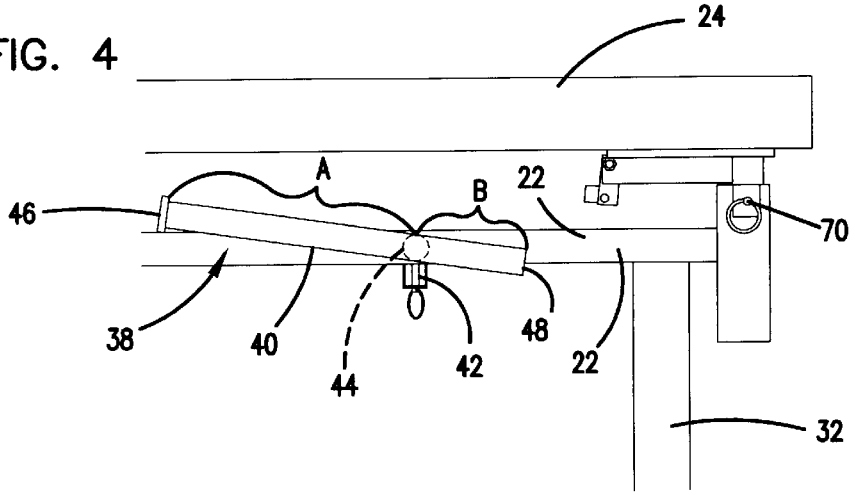
FIG. 4 shows a side elevational view of the stage and deck retainer shown in FIG. 3 with the deck retainer in a storage position.
Figure 5:
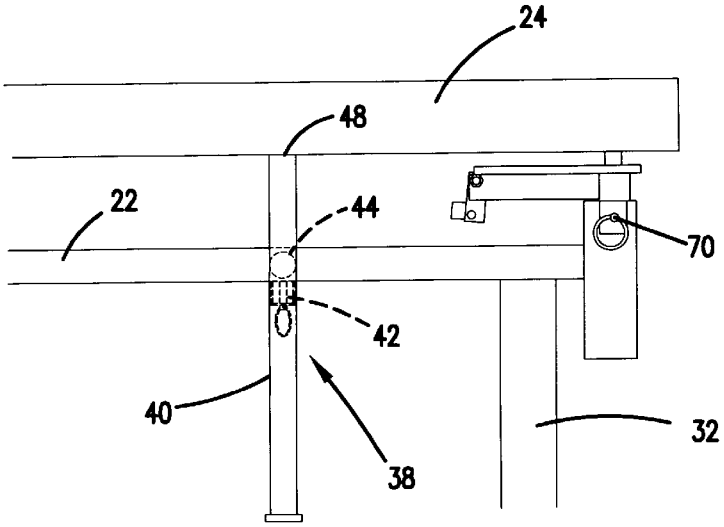
FIG. 5 shows a side elevational view of the stage and deck retainer shown in FIG. 3 with the deck retainer in a deck lifting position.

As shown in FIGS. 3–5, the retainers 38 pivot from the frame 22 about a horizontal axis at sides of the stage decks 24. Each retainer 38 has a main elongated body 40. Extending transversely to the retainer body 40 is a pivot portion 44, about which the retainer 38 rotates. The pivot portion 44 is slidably mounted to the frame 22, so that the retainer 38 may be slid toward and away from the stage 20. A spring loaded pin 42 locks the retainer 38 in various positions by engaging one of a plurality of holes formed in the pivot portion 44 corresponding to the desired angular and axial positions of the retainer 38. The retainer 38 also includes an end tab 46 at the furthest extended end of the body 40. The tab 46 extends inward towards the stage decks 24. At an opposite end of the body 40 is a lift surface 48. As explained hereinafter, the retainer 38 is utilized for retaining decks 24 and 26, as well as lifting the deck 24 for changing the position of the bridging supports. When the stage is in its use position, the retainers 38 are stored beneath the stage decks 24, as shown in FIG. 4.

Referring now to FIGS. 6–10, there are shown bridging supports 36. The support 36 has two configurations, a double support shown in FIG. 6, and a quadruple support shown in FIGS. 7–10. The double supports have two deck connectors, a pivoting connector 50 and a non-pivoting connector 68, and are utilized along the center folding line of the stage 20. The quadruple supports have four deck connectors, including three pivoting connectors 50 and one non-pivoting connector 68, and are utilized at each of the four comers of the stage 20.

Referring again to FIG. 6, each of the deck connectors 50 is configured for inserting into a bore 34 formed through one of the bridging decks 26. The inner deck connector 68 inserts into a bore 34 in the stage deck 24. The deck connectors include a core member with a bottom widened portion 56. An expandable annular ring 58 is mounted at an intermediate portion of each deck connector 50 or 68. A top member 60 extends outward over the expandable annular ring 58. The top member 60 is threadably connected to the core so that rotation of the top 60 moves the top vertically upward and downward, depending upon the direction of rotation. The top portion 60 preferably has a tool actuated top surface 62, such as for receiving a screw driver, Allen wrench or other tool. As the top portion 60 is rotated to press downward against the expandable annular ring 58, the ring 58 is compressed downward and forced to expand outward. The ring 58 engages the inner wall of the bore 34 extending through the decks 24 or 26 and retains the decks in position.

According to the present invention, each of the deck connectors 50 is pivotally mounted on a base 72 or 74. The connectors 50 rotate around a mounting pin 64, as shown most clearly in FIG. 10. The bases 72 and 74 include finger portions 76. A quadruple support base 72 has three fingers 76 while a double support base 74 includes a single finger 76. The fingers 76 include sides 80 extending from an annular post connector 82 configured for mounting in a tube member at the corner of the stage frame 22. A framework locking pin inserts through the post connector 82 and the frame 22 to lock the supports 36 in one of four predetermined positions. The round post connector 82 provides for revolving the supports 36 about the framework 22 without removing the supports 36, so that the deck supports 36 may be moved between one of the predetermined positions. The inner deck connector 68 is axially aligned with the post connector 82 so that the supports 36 may be rotated without dislodging the connector 68 or requiring removal of the stage deck 24 from the inner deck connector 68.

Figure 7:
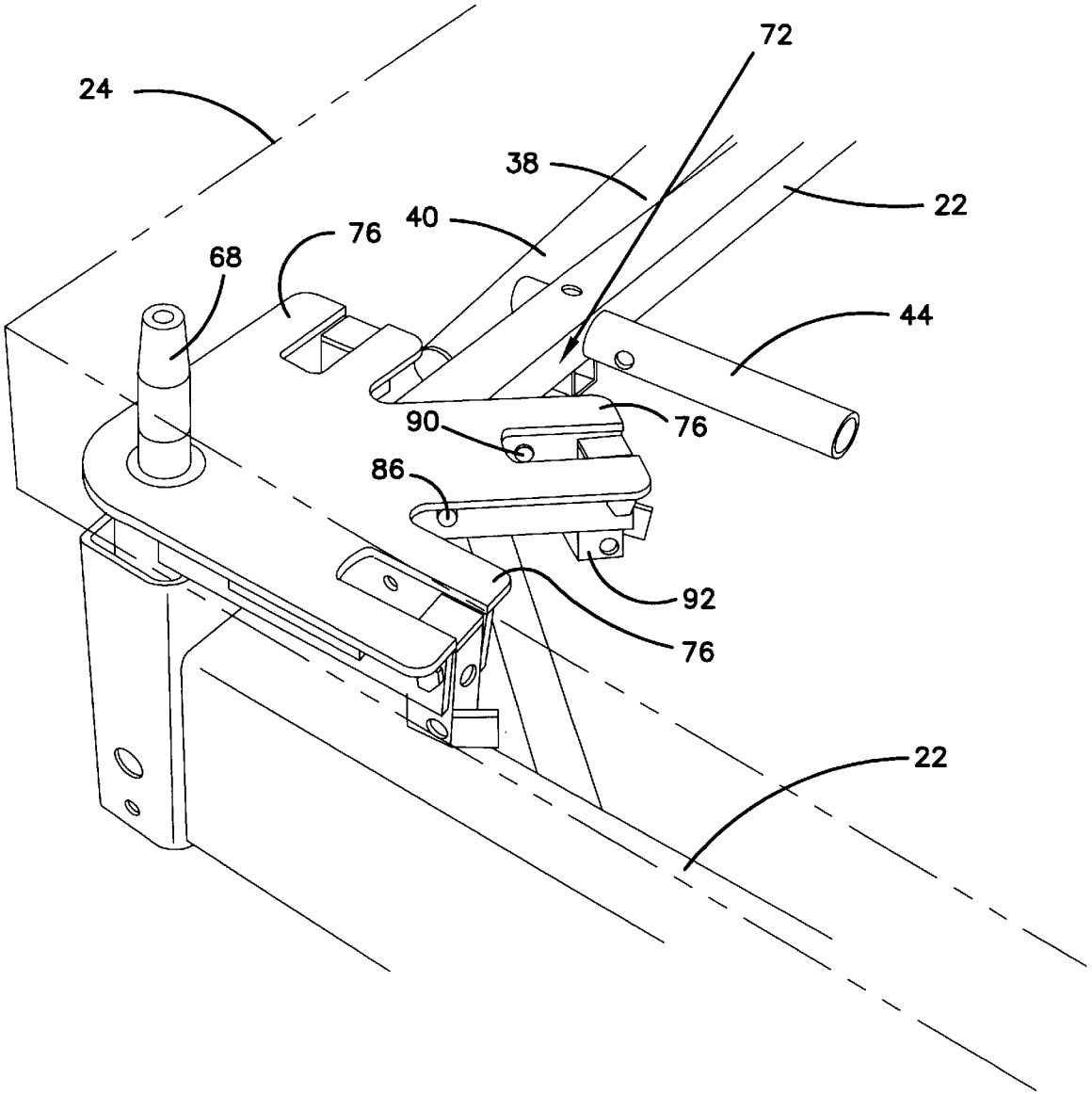
FIG. 7 shows a perspective view of a second embodiment of a bridging deck connector for the stage shown in FIG. 1 in a retracted non-bridging position.
Figure 8:
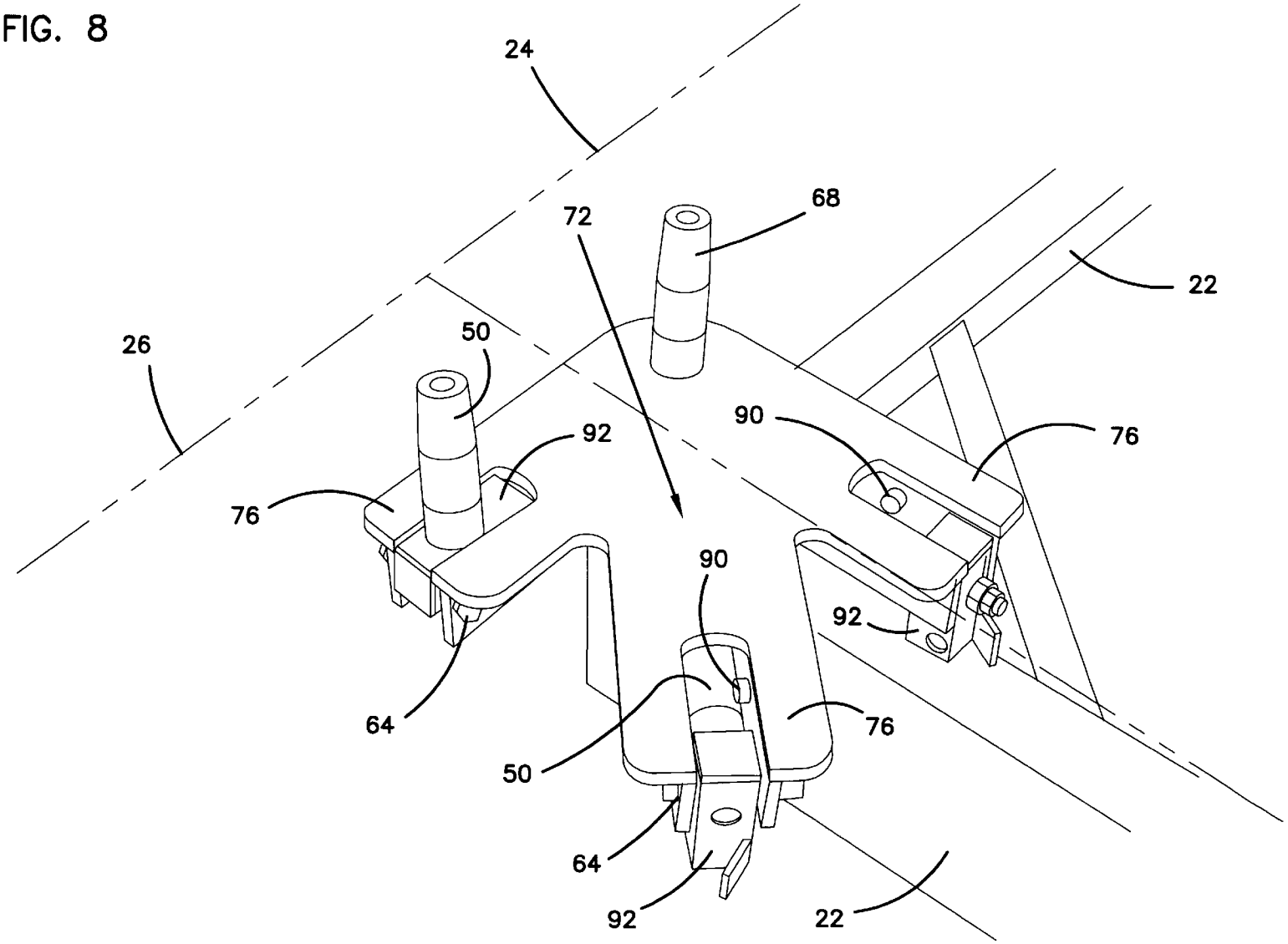
FIG. 8 shows a perspective view of the bridging deck shown in FIG. 7 supporting one bridging deck.
Figure 10:
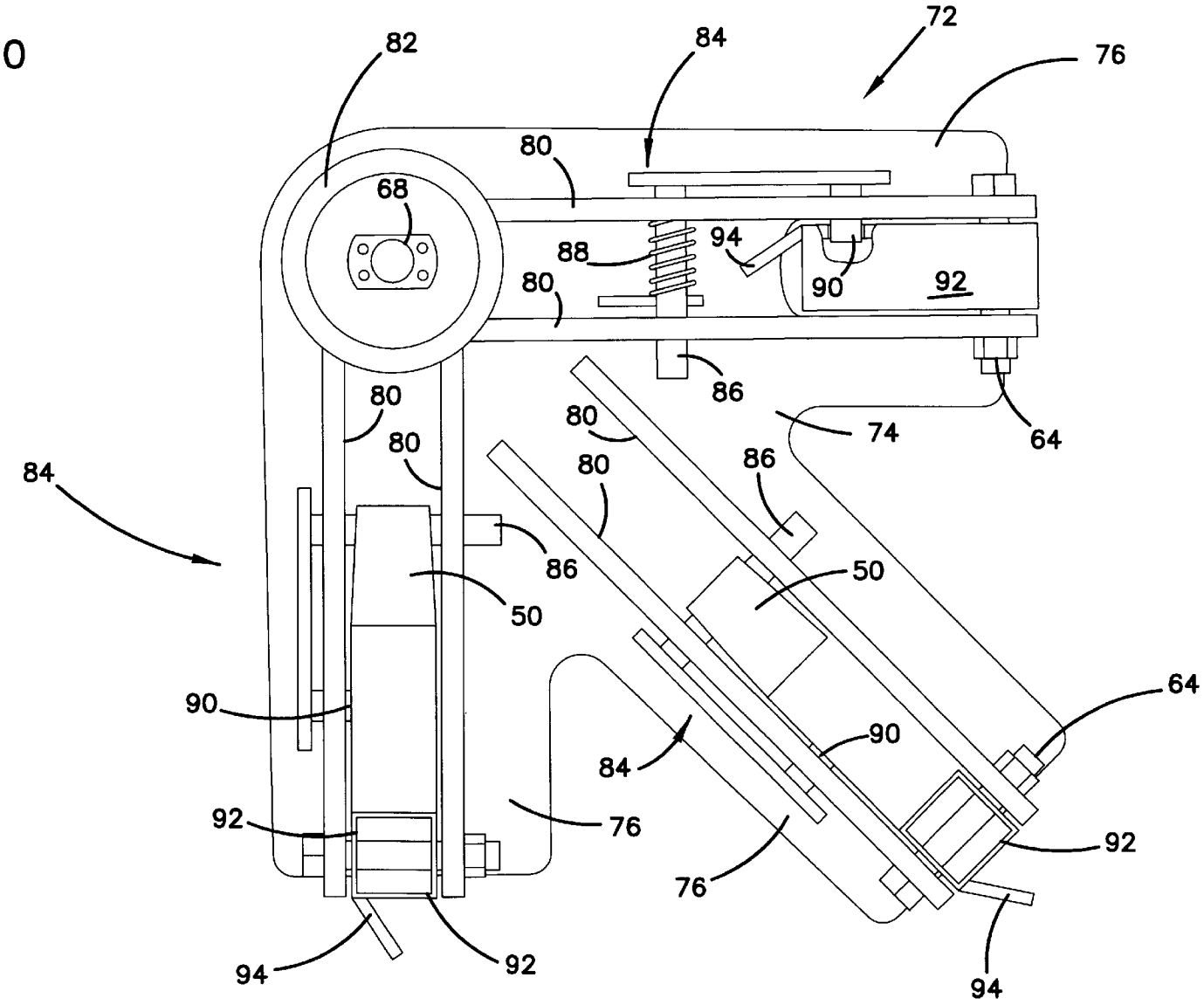
FIG. 10 shows a bottom plan view of the bridging deck connector shown in FIG. 7.

The quadruple connector bases 72 include three fingers 76 including a pair of fingers extending at right angles to one another and a center finger extending at 45 degrees intermediate the other two fingers. The deck connectors 50 are positioned such that they align with a bore 34 through bridging decks 26 abutting the stage decks 24. With this configuration, the bridging connectors 36 not only support, but also align the bridging decks 26. As shown in FIG. 10, each finger 76 includes sides 80 with a recess 78 formed between the sides 80. A lock system 84 mounts to the sides 80 of each finger 76 for locking the pivoting deck connectors 50 in position. The lock system includes a spring 88 and a release button 86. A detent 90 engages a lower portion 92 of the deck connector 50 in an engaged position or disengages the connector 50 in a release position. The lower portion 92 includes an angled tab 94 that pushes the detent 90 in to allow pivoting. The deck connectors 50 pivot between a substantially vertical position for engaging bridging decks 26 and a storage position wherein the pin portions are rotated downward below the lower surface of the decks 26, as shown in FIG. 7. When the connectors 50 are pivoted downward, the supports 36 may be rotated beneath the stage decks 24 to one of several positions.

To create an extended stage, the deck supports 36 must be rotated outward so that the required number of fingers 76, corresponding to the desired bridging arrangement, extend from the sides of the stage 20. It can be appreciated that if the stage 20 is not used for supporting bridging decks 26, the quadruple supports and double supports 36 have the pivoting connectors 50 rotated downward out of the way below the upper surfaces of the base 72 and 74 and the deck connectors 50 are pivoted to below the decks 24 so that none of the fingers 76 extend beyond the edge of the stage decks 24, as shown in FIG. 7.

However, if one or more bridging decks 26 are to be supported, the supports 36 must be pivoted outward into a supporting position. In order to do this, the inner deck connector 68 must be loosened so that it does not tightly engage the bore 34 of the stage decks 24. This allows the inner deck connector 68 to spin freely relative to the bore 34. However, the weight of the decks 24 is great enough to prevent easy turning of the deck supports 36 between the various positions. Therefore, the decks 24 must be lifted to disengage the bases 72 and 74.

Figure 6:
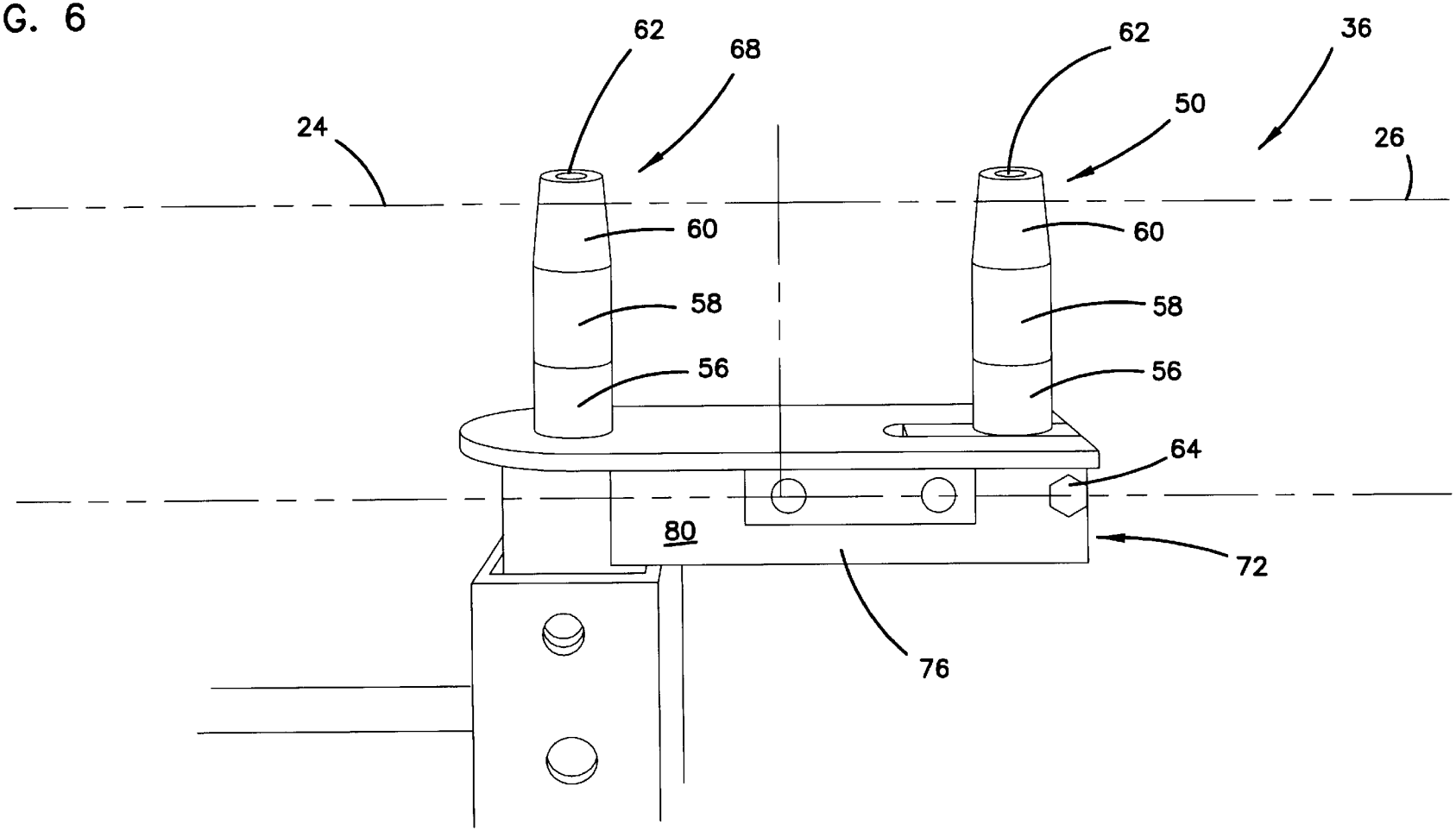
FIG. 6 shows a side elevational view of a first embodiment of a bridging deck connector for the stage shown in FIG. 1.

In order to lift the decks, the retainers 38 must be moved to the position shown in FIG. 5, wherein the retainer 38 is below the corresponding stage deck 24. The retainer 38 is then pivoted so that the end lift surface 48 engages the lower face of the deck 24 and lifts the deck upward to clear the top of the bases 72 and 74, as shown in FIG. 5. When the retainers 38 are in this position, the deck 24 is substantially lifted from the framework 22. The bore 34 is free to spin about the inner deck connector 68. The framework locking pin is then removed and the supports 36 may be turned about the annular post connector 82. If only one bridging deck 26 is being supported from the side of the stage 20, the quadruple connector base 74 is moved to the position shown in FIG. 8, or to a similar position at the other edge of the stage. At this position, although two fingers 76 extend beyond the edge of the deck, only the connector 50 corresponding to the bore 34 in the bridging deck 26 is pivoted upward while the deck connector 50 in the 45 degree extending finger is hidden below the bridging deck 26 and is retained in its lowered position. If decks 26 are being extended from the sides rather than the ends, the bases 72 of the double supports 36 are also rotated outward and the deck connector 50 is raised into its engaging position, as shown in FIG. 6. The bridging decks 26 may then be placed with the bores 34 aligning with the deck connectors 50.

Once the deck supports 36 are at their required location, the retainers 38 may be lowered to their storage position, as shown in FIG. 4. The inner deck connector 68 may then be engaged to lock the decks 24 against the stage framework 22 and the bridging deck connectors 50 are tightened to engage the bores 34 of the bridging decks 26 and connect and support the bridging decks 26.

Figure 9:
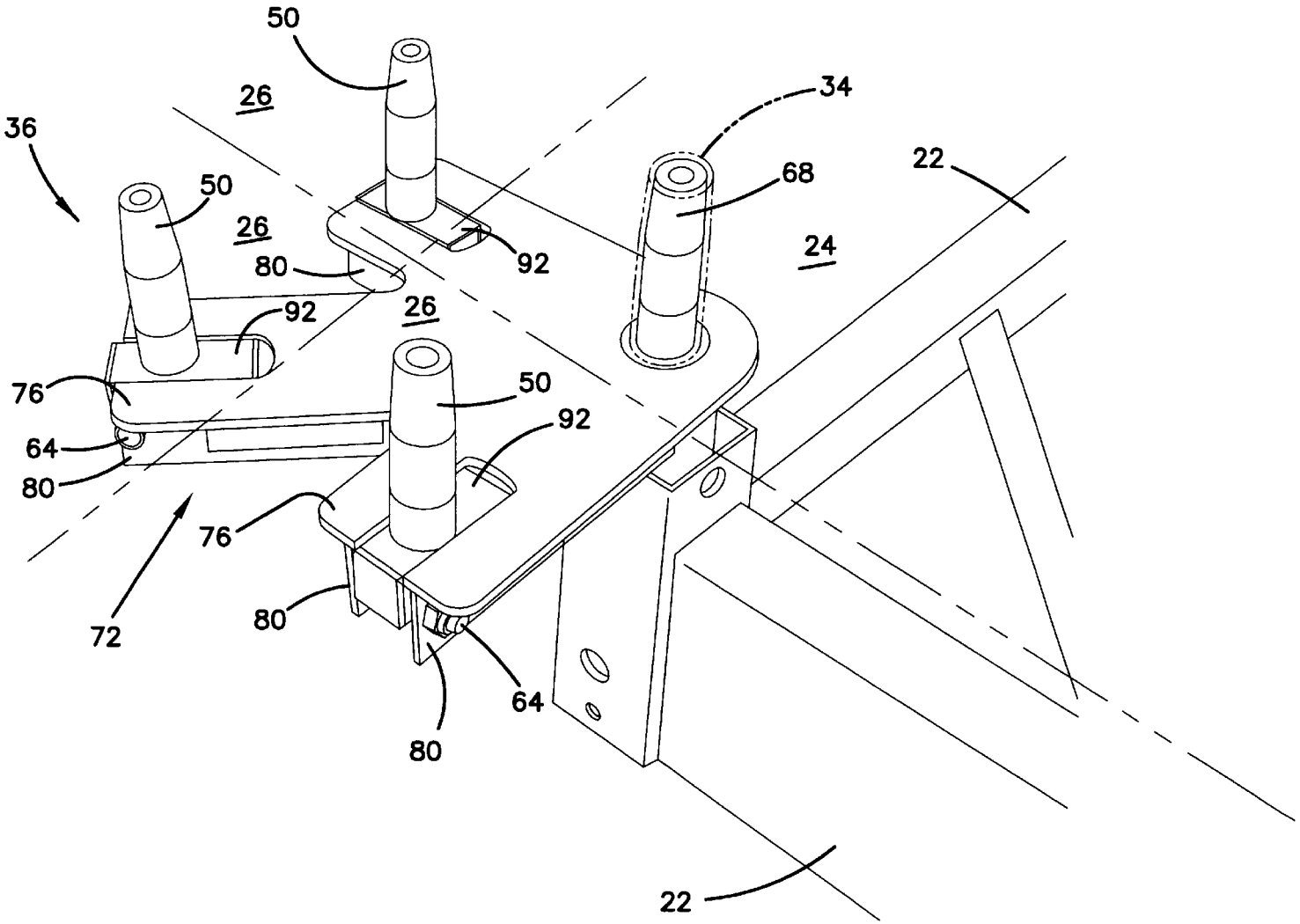
FIG. 9 shows a perspective view of the bridging deck connector shown in FIG. 7 supporting three bridging decks, shown in phantom, at one comer.

If decks 26 are being supported off the end, side and diagonally off the corner of the stage 20, the quadruple connectors bridging supports 36 must be moved to the position shown in FIG. 9 and the deck connectors 50 must be rotated into their upward engaging position. Bridging decks 26 may then be attached to the pin type deck connectors 50 and supported on each of the three fingers 76 of the quadruple supports. The framework locking pin is reinserted to retain the supports 36 at their desired rotational orientation.

In order to pivot the bridging deck connectors 50 upward, the lock system 84 is disengaged. The button 86 is pushed inward against the force of the spring 88 so that the detent 90 disengages an orifice in the lower portion 92 of the bridging deck connector 50. The bridging deck connector 50 may be rotated to its hidden or engaging position and the button 86 is released so that the detent 90 engages and locks the deck connector 50.

Once the bridging decks 26 have been removed and it is desired to either store the stage 20 or return to a non-bridging configuration, the retainers 38 must be engaged with the lift surface 48 raising the underside of the decks 24. The inner deck connector 68 must first be loosened so that the bore 34 is disengaged. The deck connectors 50 are pivoted down and the supports 36 are then turned inward to the position shown in FIG. 7 or the double supports are rotated so that the finger 76 extends beneath the deck 24. The retainers 38 are then rotated down and moved to the storage position as shown in FIG. 4 and the inner deck connectors 68 may be tightened to engage the bores 34 in the stage decks 24.

The retainers 38 provide a mechanical advantage so that lifting the decks 24 is easily performed by one person. However, it can be appreciated that the retainers 38 must slide inward and outward as the end lift surface 48 must be below the stage deck 24 in the lifting position shown in FIG. 5. The retainer 38 is also slid inward to be stored out of the way and beneath the decks 24 in the storage position shown in FIG. 4. However, in the retainer position as shown in FIG. 3, and for retaining bridging decks 26 against the decks 24, the retainer 38 is slid outward away from the stage 20 so that the end retaining tab 46 holds the sides of the decks 24 and 26. The retainer 38 is slid inward when the end tab 46 is above the top most deck 26 and moved inward so that the tab 46 engages the top surface of the upper deck 26. The end lift surface 48 is a distance A from the axis of rotation through the pivot portion 44 while the end tab 46 is a distance B from the axis and rotation through the pivot portion 44. In order to provide lifting, storage and retention, the distance B must be greater than the distance A to accommodate the height of the decks 24 and 26.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A deck and retainer apparatus, comprising a retainer member rotatably mounted about an axis of rotation below the deck, including a longitudinal portion, an end tab portion extending from a first end of the longitudinal portion, and a second end having an engaging portion, wherein the axis of rotation is closer to the second end than the first end, wherein the retainer member rotates between a first position wherein the tab extends above the deck, a second position wherein the second end engages and lifts a bottom of the deck, and a third storage position wherein the first and second ends are below and disengaged from the deck.

2. A deck and retainer apparatus according to claim 1, wherein the retainer member is horizontally slidably mounted to slide between a position below the deck and a position beside the deck whereat the deck is not within the retainer's path of rotation.

3. A deck and retainer apparatus according to claim 1, further comprising a lock locking the retainer in position.

4. A folding stage system, comprising:

a frame;

a first stage deck;

a connector connecting the first stage deck to the frame;

a second deck bridging between two frames to form an extended stage surface;

a retainer rotatably mounted to the frame including a longitudinal portion, an end tab portion extending from a first end of the longitudinal portion, and a second end having an engaging portion, wherein the retainer rotates between a first position wherein the retainer is below the first stage deck, a second position wherein the tab is above the first stage deck, and a third storage position.

5. A folding stage according to claim 4, wherein the retainer slidably mounts relative to the first stage deck and slides substantially horizontally between a position beneath the first stage deck to a position beside the first stage deck.

6. A folding stage system according to claim 4, wherein the second deck stores on the first stage deck, and wherein the tab extends over the second deck at the retainer's second position.

7. A deck and retainer, comprising a retainer member rotatably mounted about an axis of rotation, including a longitudinal portion, an end tab portion extending from a first end of the longitudinal portion, and a second end having an engaging portion, wherein the retainer member rotates between a first position wherein the tab extends above the deck, a second position wherein the second end engages and lifts a bottom of the deck, and a third storage position.

8. A deck and retainer according to claim 7, wherein the first and second end are below and disengaged from the deck at the storage position.

* * * * *

UNITED STATES PATENT AND TRADEMARK OFFICE

CERTIFICATE OF CORRECTION

PATENT NO. : 6,164,016
DATED : December 26, 2000
INVENTOR(S) : Richard C. Bue and Mark DeSimone It is certified that error appears in the above-identified patent and that said Letters Patent is hereby corrected as shown below:

Column 1,
Line 16, delete "patent application Ser." and insert -- Pat. --

Signed and Sealed this

Sixteenth Day of April, 2002

*Attest:*

*Attesting Officer*

JAMES E. ROGAN
*Director of the United States Patent and Trademark Office*